US005400589A

United States Patent [19]

Mahias et al.

[11] Patent Number: 5,400,589

[45] Date of Patent: Mar. 28, 1995

[54] AFTERBURNER FOR A TURBOFAN ENGINE

[75] Inventors: Olivier M. M. Mahias, Montgeron; Xavier J. Pasquali, Le Mee sur Seine; Jacques A. M. Roche, Lisses; Mireille S. N. Romero, Melun; Elisabeth Vilfeu, Etioles, all of France

[73] Assignee: Societe Nationale d'Etude et de Construction de Moteurs d'Aviation S.N.E.C.M.A., Valin, France

[21] Appl. No.: 132,245

[22] Filed: Oct. 6, 1993

[30] Foreign Application Priority Data

Oct. 7, 1982 [FR] France ..... 92 11859

[51] Int. Cl.[6] ..... F02K 3/10; F02K 1/48

[52] U.S. Cl. ..... 60/261; 60/262; 60/749

[58] Field of Search ..... 60/261, 749, 738, 262, 60/226.1

[56] References Cited

U.S. PATENT DOCUMENTS

| | | | |
|---|---|---|---|
| 3,315,468 | 4/1967 | Vdoviak | 60/749 |
| 3,750,402 | 8/1973 | Vdoviak et al. | 60/261 |
| 3,800,530 | 4/1974 | Nash | 60/261 |
| 4,887,425 | 12/1989 | Vdoviak | 60/261 |
| 4,901,527 | 2/1990 | Nash et al. | 60/749 |
| 5,020,318 | 6/1991 | Vdoviak | 60/226.1 |
| 5,181,379 | 1/1993 | Wakeman et al. | 60/261 |
| 5,209,059 | 5/1993 | Ward | 60/261 |
| 5,212,945 | 5/1993 | Habrard | 60/261 |

*Primary Examiner*—Timothy S. Thorpe
*Attorney, Agent, or Firm*—Bacon & Thomas

[57] ABSTRACT

An afterburner for a turbofan engine is disclosed having a plurality of connecting arms connecting the inner wall to the outer wall wherein each of the connecting arms defines an air chamber, an inlet communicating with the main air bypass passageway and a plurality of outlets communicating with the afterburner chamber. The plurality of connecting arms are distributed generally radially about the longitudinal axis of the engine and serve to distribute a portion of the bypass air into the afterburner chamber. The bypass air is further distributed into the afterburner chamber through a plurality of flame holders extending radially inwardly from the outer wall towards the longitudinal axis. Each of the flame holders also defines an air chamber, an inlet communicating with the main air bypass passageway and a plurality of air outlets. The flame holders may also be distributed in a radial array about the longitudinal axis and are interposed between adjacent connecting arms.

44 Claims, 7 Drawing Sheets

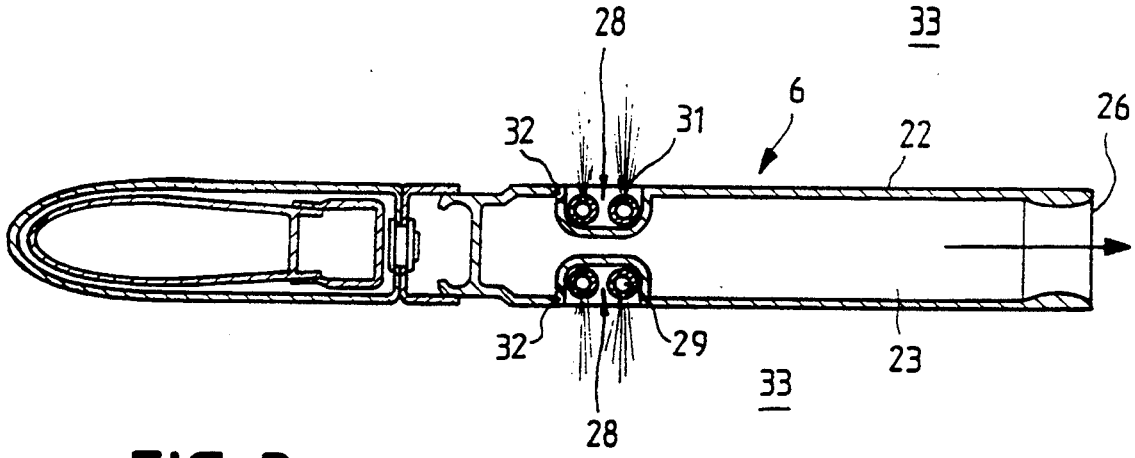
FIG. 3
FIG. 4
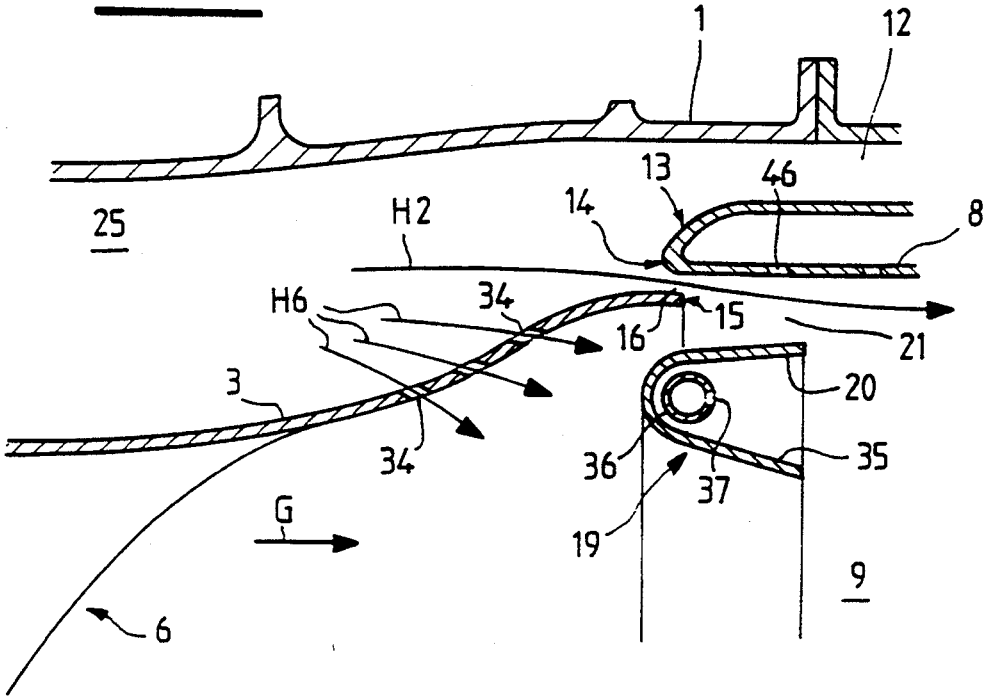

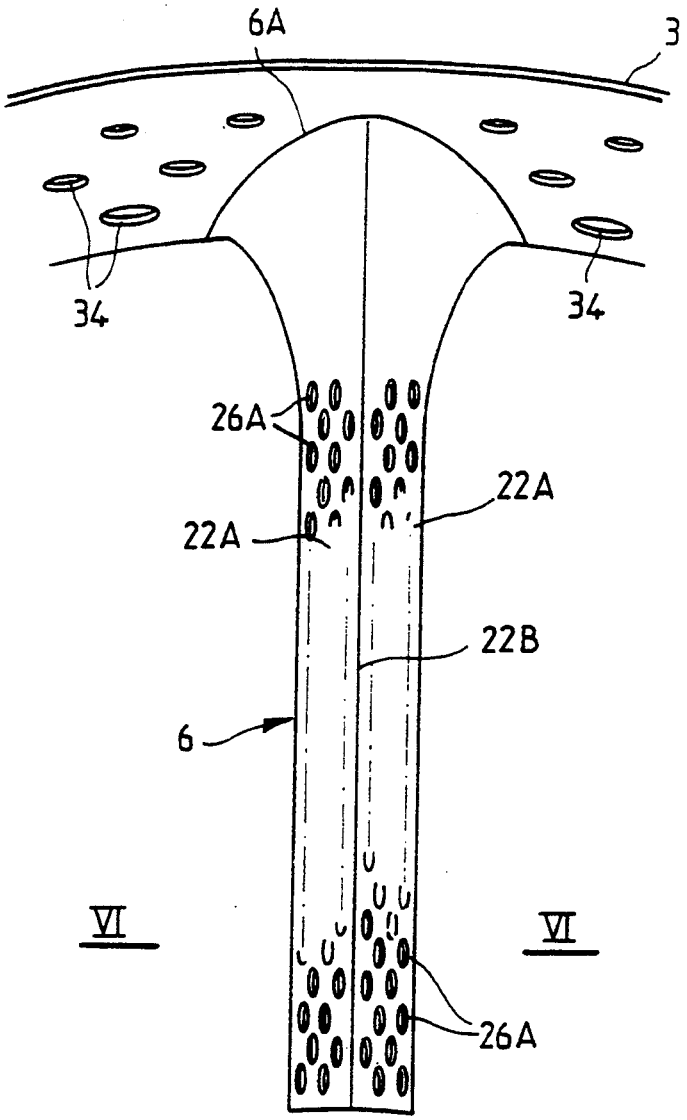
FIG. 5
FIG. 6
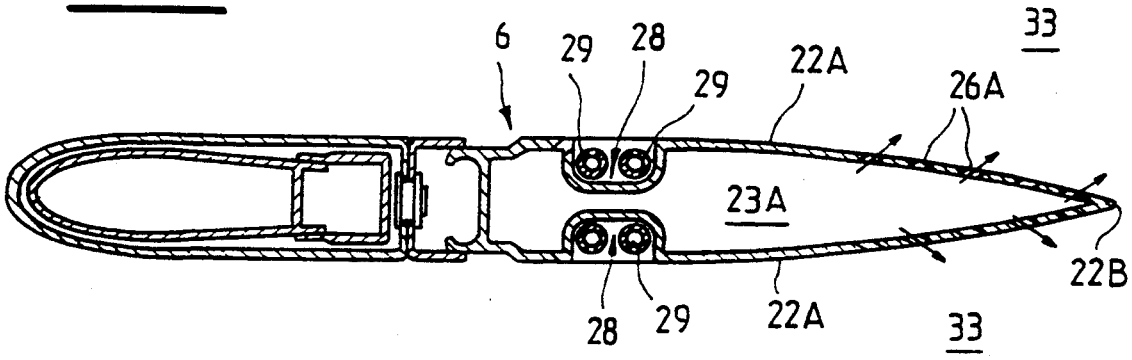

AFTERBURNER FOR A TURBOFAN ENGINE

BACKGROUND OF THE INVENTION

The present invention relates to an afterburner for a turbofan-type jet aircraft engine, more particularly such an afterburner which achieves a more uniform distribution of the combustion air to promote fuel/air mixing and improve flame stability.

Afterburners for turbofan-type jet engines are known which comprise an external annular casing formed as a body of revolution extending about a longitudinal axis with an exhaust case contained within the external casing. The turbofan engine may also comprise outer and inner annular walls extending about the longitudinal axis spaced from each other and spaced inwardly from the external casing so as to define a main bypass air passageway between the outer wall and the external casing. Connecting arms may join the inner wall to the outer wall.

The afterburner also comprises an annular afterburner wall extending about the longitudinal axis and spaced inwardly from the external casing so as to define the outer boundaries of the afterburner chamber and to define a cooling air passageway between the afterburner wall and the external casing.

Efficient afterburner design requires low pressure losses, excellent mixing of the primary and secondary gas flows and must provide safeguards against instability of combustion. The known afterburner designs have failed to completely address all of these criteria.

SUMMARY OF THE INVENTION

An afterburner for a turbofan engine is disclosed having a plurality of connecting arms connecting the inner wall to the outer wall wherein each of the connecting arms defines an air chamber, an inlet communicating with the main air bypass passageway and a plurality of outlets communicating with the afterburner chamber. The plurality of connecting arms are distributed generally radially about the longitudinal axis of the engine and serve to distribute a portion of the bypass air into the afterburner chamber.

The bypass air is further distributed into the afterburner chamber through a plurality of flame holders extending radially inwardly from the outer wall towards the longitudinal axis. Each of the flame holders also defines an air chamber, an inlet communicating with the main air bypass passageway and a plurality of air outlets. The flame holders may also be distributed in a radial array about the longitudinal axis and are interposed between adjacent connecting arms.

A further air passage is formed between a downstream end of the outer wall and an upstream edge of the afterburner wall, which passage also communicates with the main air bypass passageway. Furthermore, the portion of the outer wall located downstream of the connecting arms also defines a plurality of apertures to enable the air from the main air bypass passageway to pass into the afterburner chamber.

Each of the connecting arms may have a downstream surface facing the afterburner chamber which extends substantially perpendicular to the longitudinal axis and which defines the plurality of air outlets. Alternatively, the connecting arm can be formed with converging opposite sides which converge at the downstream edge closest to the afterburner chamber wherein each of the opposite sides defines the plurality of air outlet openings. In either case, the opposite sides of the connecting arms define channels which extend generally radially with respect to the longitudinal axis and in which are located fuel conduits to inject fuel into the exhaust gas stream passing around the connecting arms. The fuel conduits have fuel outlet orifices which are oriented substantially perpendicularly with respect to the longitudinal axis.

The afterburner further has an afterburner ring located coaxially with respect to the afterburner wall and disposed inwardly of the wall so as to define therebetween a passageway communicating with the afterburner chamber.

The structure of the afterburner according to this invention provides a very homogeneous mixture of the bypass air and the exhaust gases from the jet engine whereby satisfactory afterburning characteristics can be achieved.

BRIEF DESCRIPTION OF THE DRAWINGS

FIG. 3 is a cross-sectional view taken along line III—III of FIG. 2.

FIG. 4 is a partial, axial, cross-sectional view taken along line IV—IV of FIG. 1.

FIG. 5 is a rear view of an alternative embodiment of the connecting arm shown in FIG. 1.

FIG. 6 is a cross-sectional view taken line VI—VI in FIG. 5.

DETAILED DESCRIPTION OF THE PREFERRED EMBODIMENTS

Figure 1:
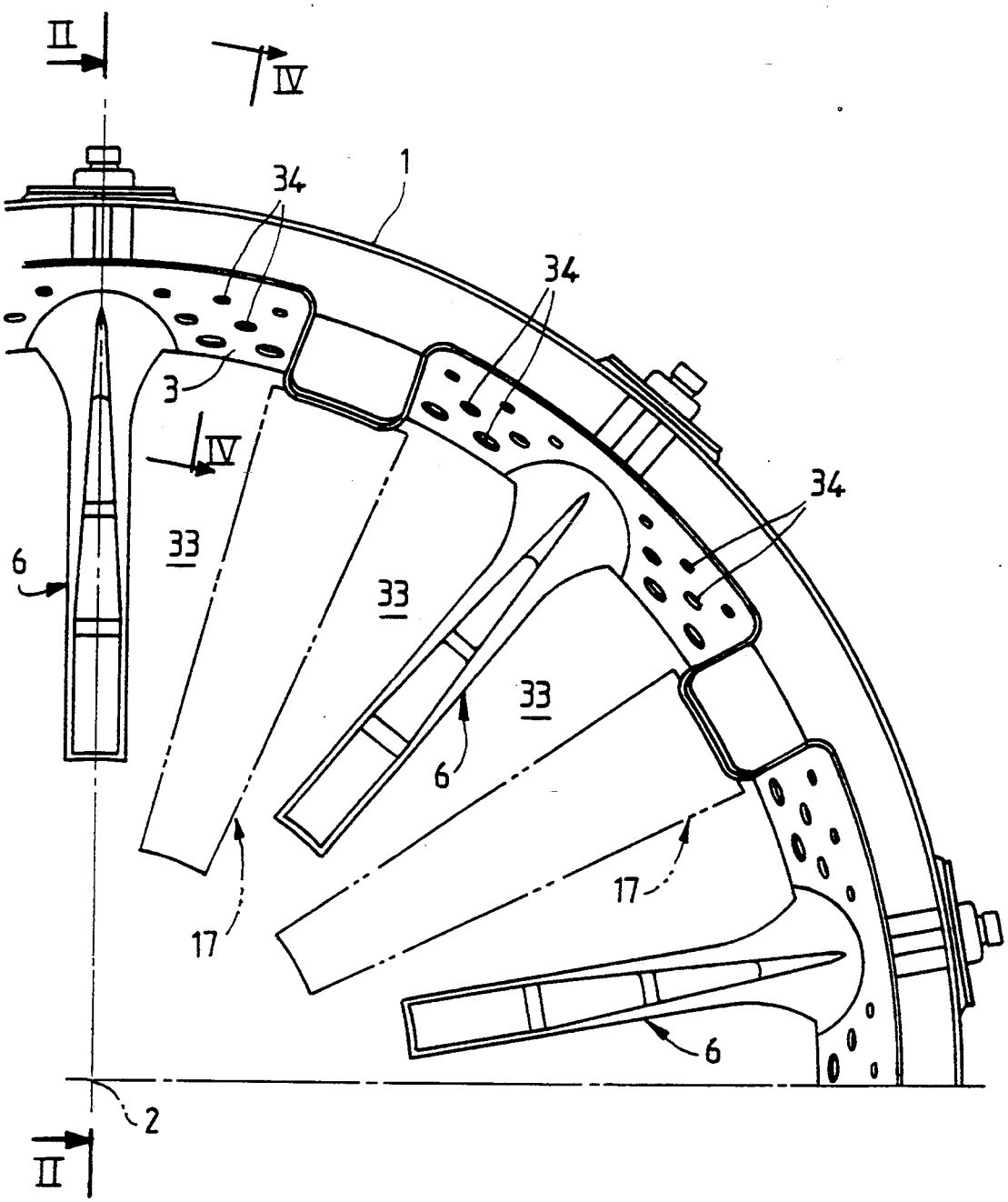
FIG. 1 is a partial, cross-sectional view of an afterburner according to the present invention taken along line I—I in FIG. 2.

The afterburner according to the invention comprises an annular external casing I formed as a body of revolution about longitudinal axis 2 and an exhaust gas casing 18 for the gases that have passed through the engine which comprises a generally annular outer wall 3 extending about axis 2 which is connected by link rods 4 to the external casing 1. The exhaust gas case 18 also comprises an inner annular wall 5 extending about axis 2 which is connected to the outer wall 3 by a plurality of connecting arms 6 which extend generally radially with respect to the longitudinal axis 2. Annular wall 7 also extends about axis 2 and extends the inner wall 5 downstream, in the direction of arrow G in FIG. 2.

Annular afterburner wall 8 extends about axis 2 and is located within the external casing 1 such that it has a greater diameter about axis 2 than does outer wall 3. Afterburner wall 8, along with annular wall 7, defines the inner and outer boundaries of afterburner chamber 9. Afterburner wall 8 defines a plurality of cooling holes 46 whose axes are skewed relative to the longitudinal axis 2, as best seen in FIG. 4.

Wall 10 is generally coaxial with afterburner wall 8 and is located between the afterburner wall 8 and the external casing 1 and defines a downstream aperture 11 which communicates with the space 12 between the annular wall 10 and the external casing 1. The upstream end of the annular wall 10 has a generally frustoconical portion 13 which joins the upstream edge 14 of afterburner wall 8 such that the edge 14 is adjacent to the downstream end 15 of the outer wall 3, but which is spaced from the downstream end 15 of the outer wall so as to define an annular passageway 16 between these two elements. Annular passageway 16 provides communication between the afterburner chamber 9 and the main air bypass passageway 25.

Figure 8:
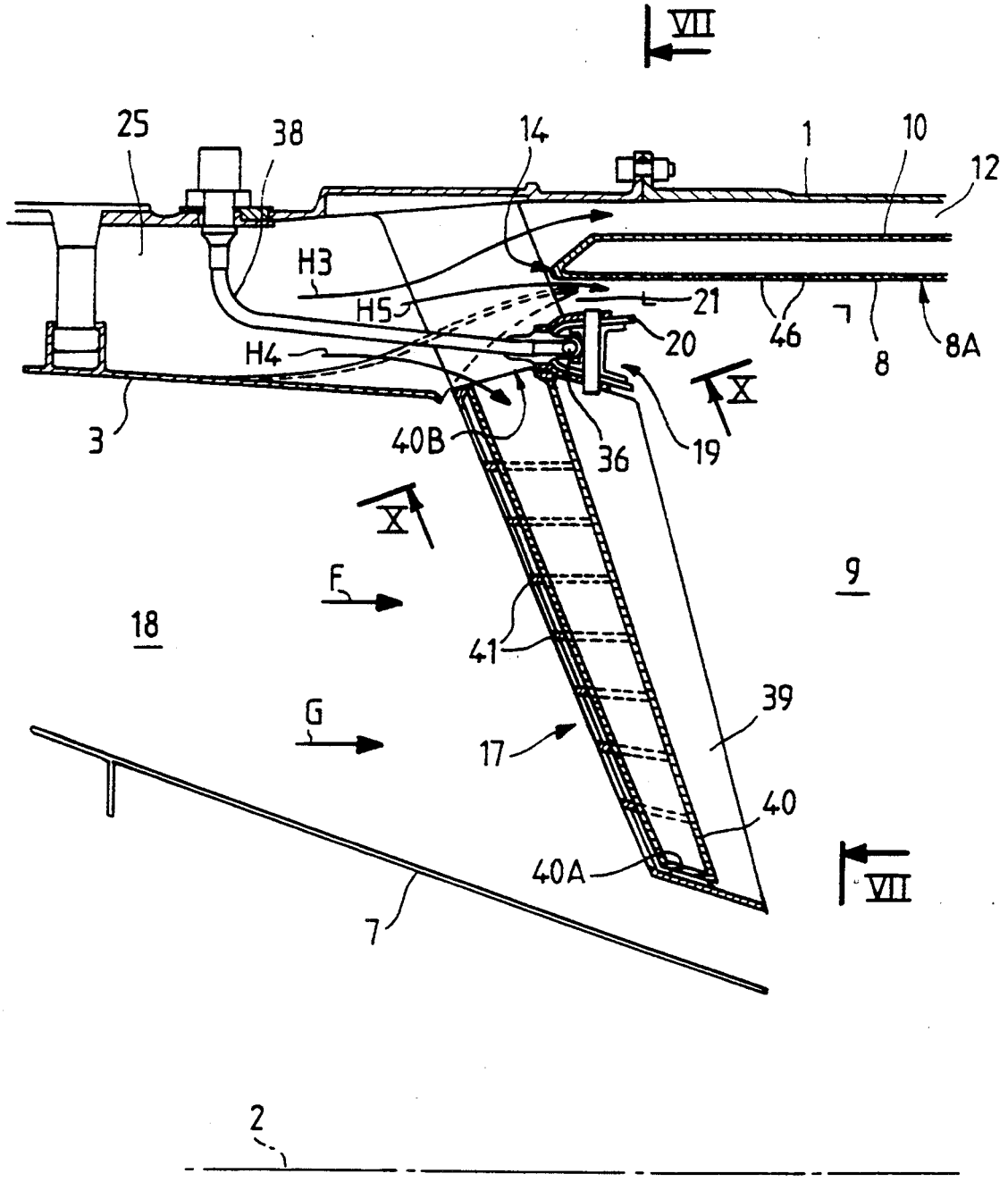
FIG. 8 is a partial, axial, cross-sectional view taken along line VIII—VIII in FIG. 7 illustrating the flame holder according to the present invention.
Figure 9:
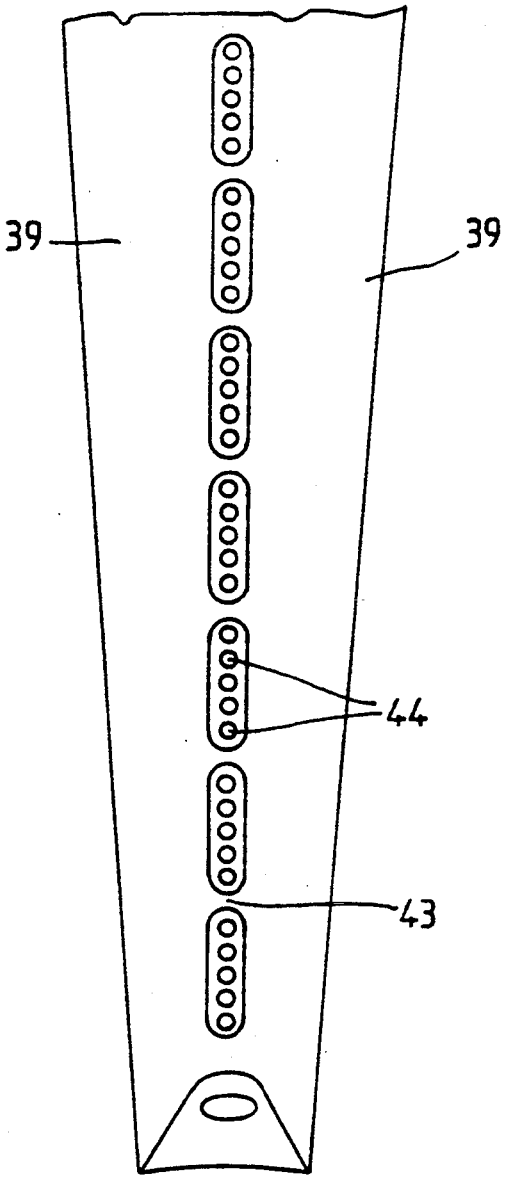
FIG. 9 is a partial, front view of the flame holder taken in the direction of arrow F in FIG. 8.
Figure 10:
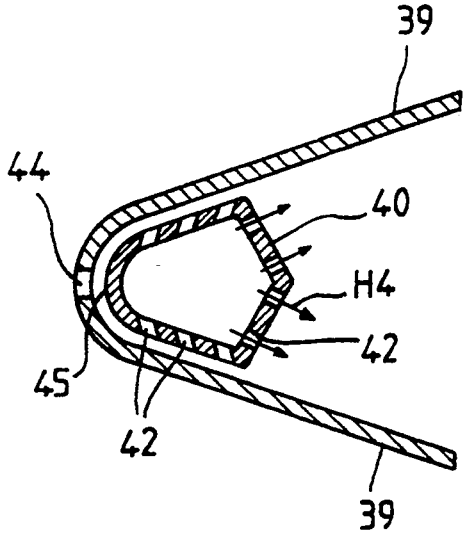
FIG. 10 is a cross-sectional view of the flame holder of FIG. 8 taken line X—X in FIG. 8.

Flameholder arms 17 are affixed to the outer wall 3 adjacent to its downstream end and extend generally radially inwardly toward the longitudinal axis 2 while being annularly equidistantly spaced between the adjacent connecting arms 6. The afterburner also includes a burner ring 19 which is generally annular in configuration and which extends about the longitudinal axis 2 affixed to the flameholder 17 near the edge 14 so as to define a passageway 21 between the outer leg 20 of the burner ring 19 and the annular wall 8, as best illustrated in FIG. 8.

Figure 2:
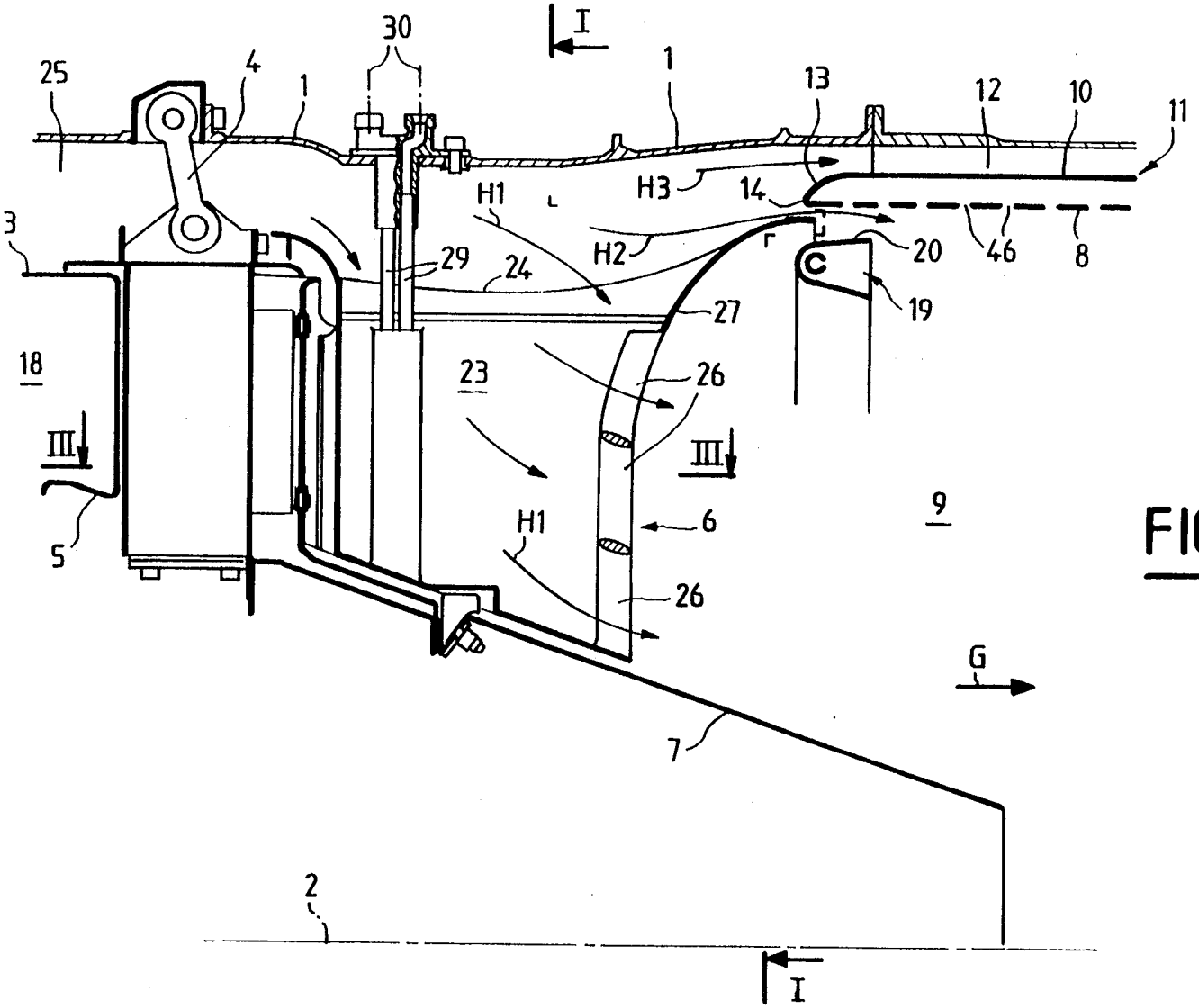
FIG. 2 is a partial, axial cross section of the connecting arm of the afterburner of Figure I taken along line II—II of FIG. 1.
Figure 7:
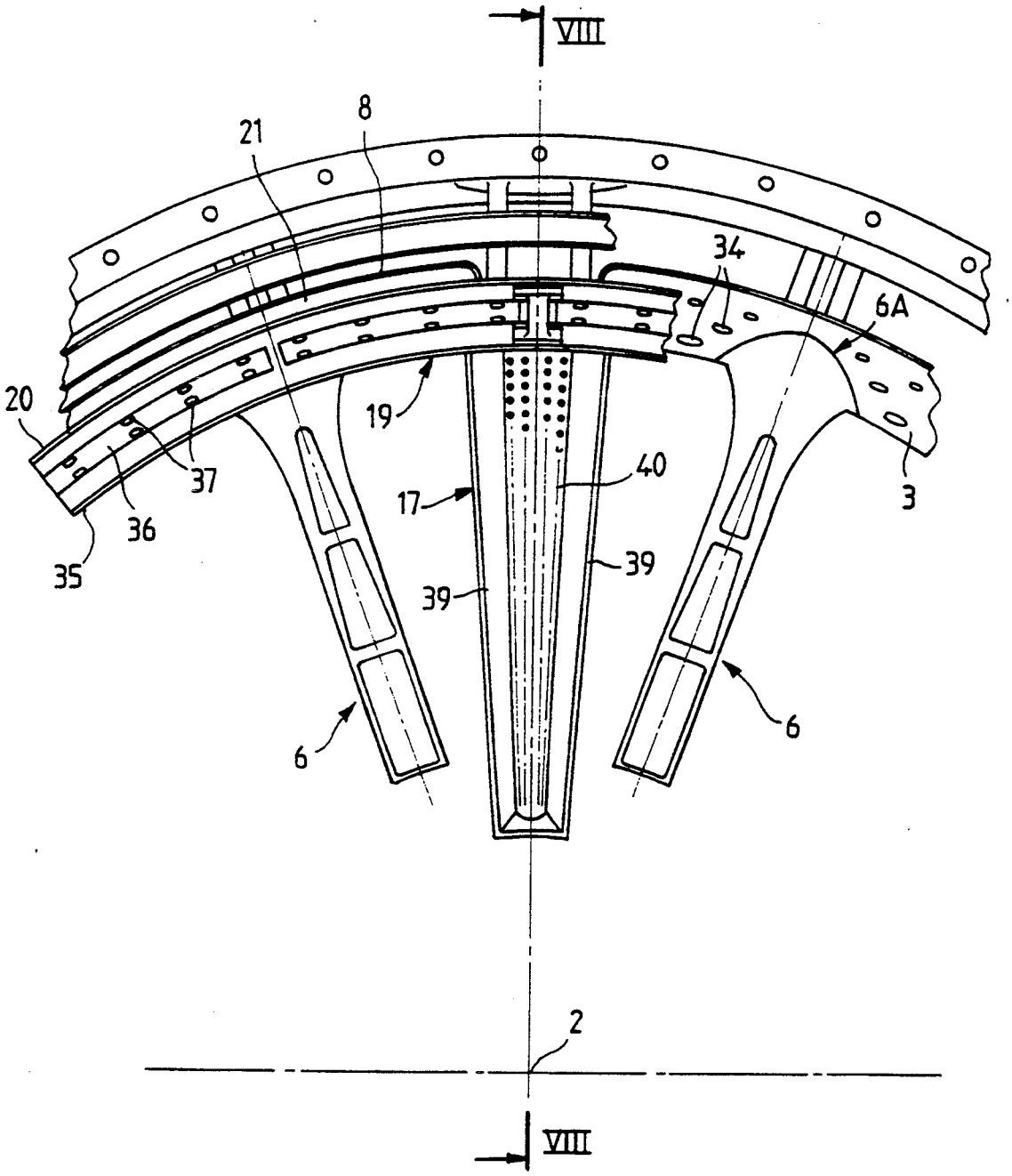
FIG. 7 is a partial, lateral, cross-sectional view taken along line VII—VII in FIG. 8.

Each connecting arm 6, as best seen in FIGS. 1 and 2, comprises opposite sidewalls 22 spaced apart from each other which define between them an air chamber 23 which communicates through an inlet 24 with the main air bypass passageway 25. Air chamber 23 also communicates with the afterburner chamber 9 through a plurality of air outlets 26 formed in a downstream end wall 27 of the connecting arm. Wall 27 extends generally perpendicular to the longitudinal axis 2.

The opposite walls 22 of the connecting arm 6 define a radially extending channel 28 in which are located fuel conduits 29 operatively connected to a fuel supply (not shown) via fuel lines 30 located outside of the external casing 1. The fuel conduits 29 define fuel orifices 31 which are oriented generally perpendicular to the wall 22 and perpendicular to the longitudinal axis 2. Orifices 31 comprise fuel injection orifices for injecting fuel upstream of the afterburner chamber 9. The connecting arm 6 also defines holes 32 located at the upstream edge of each channel 28, which holes communicate between the external passageways 33 between adjacent connecting arms 6 and the air chamber 23 to provide communication between the exhaust case 18 and the afterburner chamber 9.

An alternative structure of the connecting arms 6 is shown in FIGS. 5 and 6. In this embodiment, the opposite sides 22A converge toward each other in a downstream direction and join at downstream edge 22B. The air outlets 26A are defined by the downstream portions of opposite walls 22A facing obliquely in a downstream direction. The function of the channels and the fuel conduits are the same as in the previously described embodiment.

Outer wall 3 defines a plurality of apertures 34 near its downstream edge between the downstream edge of the connecting arm 6 and the fuel ring 19. Apertures 34 allow further communication between the main bypass air passageway 25 and the afterburner chamber 9.

The burner ring 19 comprises an annular structure extending generally in a plane perpendicular to the longitudinal axis 2. As can be seen in FIG. 4, the burner ring 19 comprises a generally "V"-shaped cross section having legs 20 and 35 extending from the apex of the "V", which points in an upstream direction generally opposite to that of the gas flow indicated by arrow G. A toroidal conduit 36 is located within the "V" shaped burner ring and defines a plurality of cross holes 37 whose axes are generally parallel to and face in the direction of arrow G. The toroidal conduit 36 is connected, via known means, to several fuel supply conduits 38 (see FIG. 8) to supply fuel to the afterburner chamber. The apertures 34 defined by the outer wall 3 allow air to enter the afterburner chamber 9 near the upstream side of the "V"-shaped burner ring 19, as best illustrated in FIG. 4.

Each flame holder 17 also has a generally "V"-shaped cross-sectional configuration with legs 39 extending from the apex, which points in an upstream direction opposite that of the gas flow indicated by arrow G in FIG. 8. Conduit 40 is located within the two legs 39 and is affixed to the legs 39 by flanges 41. The conduit 40 defines a second air chamber having a closed end 40A and an open end 40B which communicates with the bypass air passageway 25. The conduit 40 also defines a plurality of air outlet holes 42 oriented such that each of the outlets faces at least somewhat in a downstream direction. The apex 43 of the flame holder arm 17 also defines a plurality of openings 44 whose axes are generally parallel to the direction of gas flow indicated to arrow G in FIG. 8. The holes allow air to pass through and impinge on the upstream edge 45 of the conduit 40.

As can best be seen in FIGS. 2, 4, 8 and 10, the afterburner of the present invention provides a variety of air flow passages to facilitate the homogeneous mixing of the oxidizer air with the exhaust gases and the fuel. Air flow H 1, which comprises about 35% of the bypass air in the main passageway 25, enters the afterburner chamber 9 by passing through the air inlet 24, the air chamber 23 and the air outlets 26 of the connecting arms 6 which defines a first bypass air passageway. The selection of the shapes and the locations of the air outlets 26 enables air to be present, even at the core of the primary gas flow from the exhaust case 18 in order to minimize the temperature variation across the lateral dimension of the afterburner, thereby reducing the infrared radiation from the engine. In the alternative embodiment illustrated in FIGS. 5 and 6, the location, the number and the sizes of the outlets 26A also allow optimizing the temperature variation profile.

Air flow H2 enters the afterburner chamber 9 from the main air bypass passageway 25 through annular passageway 16 and passageway 21 located between the burner ring 19 and the annular afterburner wall 8 constituting a second bypass air passageway. This air flow also cools the structure in the vicinity of the upstream edge 14 of the afterburner wall 8, particularly during afterburner operation.

Air flow H3 passes from the main air bypass passageway 25 through the annular space 12 and opening 11 into the space between the walls 8 and 10. This flow is exhausted through the holes 46 to ensure cooling of the afterburner wall 8 bounding the afterburner chamber 9.

Air flow H4 from the main bypass air passageway 25 passes into the afterburner chamber 9 via inlet 40B, the air chamber defined by the conduit 40 and through the openings 42. This air flow also serves to cool the flameholder arms 17.

A fifth air flow, indicated by arrows H5, from the main bypass air passageway 25 crosses the passageways 21 defined between the legs 39 of the adjacent flame-holders 17, the afterburner wall 8 and the outer leg 20 of the burner ring 19 whereupon it mixes with the main airflow passing through the afterburner chamber 9.

A sixth air flow, indicated by arrows H6 enters the afterburner chamber 9 through apertures 34 to thereby cool the burner ring 19 such that the gas reaches a temperature between that of the primary flow having crossed the exhaust case 18 and that of the fresh incoming bypass air from the main bypass air passageway 25.

The geometry and the arrangement of the flameholder arms 17 of the burner ring 19 allow the reduction of pressure drops within the afterburner and generate an equivalent radar cross section of only slight magnitude. By this distribution of the bypass air flow, the afterburner according to the present invention is able to achieve improved afterburner stability, extended ignition range, high combustion efficiency and reduction of the infrared radiation. The arrangement and configuration of the flame holders 17 and the burner ring 19 also assist in reducing the pressure losses and lessening the effective radar cross section, while at the same time reducing thermal gradients across the transverse dimensions of the afterburner.

The foregoing description is provided for illustrative purposes only and should not be construed as in any way limiting this invention, the scope of which is defined solely by the appended claims.

We claim:

1. An afterburner for a turbofan engine having a generally annular external casing extending about a longitudinal axis, an outer wall spaced inwardly from the external casing so as to define a main air bypass passageway therebetween, an inner wall spaced inwardly from the outer wall so as to define an exhaust gas casing and a generally annular afterburner wall spaced inwardly from the external casing and defining an outer boundary of an afterburner chamber, comprising at least one connecting arm connecting the inner wall to the outer wall, each connecting arm defining: an air chamber; at least one inlet opening defined by the connecting arm communicating between the air chamber and the main air bypass passageway to allow a portion of the bypass air to pass into the air chamber; at least one outlet opening defined by the connecting arm and communicating between the air chamber and the afterburner chamber to allow air in the air chamber to pass into the afterburner chamber so as to form a first bypass air passageway; and a downstream end wall oriented in a plane extending substantially perpendicular to the longitudinal axis, the end wall defining the at least one outlet opening, wherein each connecting arm has opposite sides, each opposite side defining a channel extending radially with respect to the longitudinal axis and further comprising at least one fuel conduit disposed in each channel.

2. The afterburner of claim 1 wherein each fuel conduit defines fuel outlet orifices oriented substantially perpendicularly to the longitudinal axis.

3. The afterburner of claim 1 further comprising a plurality of cooling holes defined by the afterburner wall communicating with the main air bypass passageway.

4. The afterburner of claim 1 further comprising at least one flameholder extending inwardly from the outer wall, each flameholder defining: a second air chamber; a second inlet communicating with the main air bypass passageway and the second air chamber; and a plurality of second outlets communicating between the second air chamber and the afterburner chamber.

5. The afterburner of claim 4 wherein the each flameholder has a substantially "V"-shaped cross-section and further comprising an air conduit located between the legs of the substantially "V"-shape the air conduit defining the second air chamber, the second inlet and the plurality of second outlets.

6. The afterburner of claim 5 wherein the apex of the substantially "V"-shaped flameholder faces away from the afterburner chamber.

7. The afterburner of claim 5 wherein the substantially "V"-shaped flameholder defines a plurality of holes adjacent the apex of the "V" located so as to communicate between the exhaust gas passageway and a space between the legs of the "V" shape.

8. The afterburner of claim 4 further comprising a generally annular burner ring extending about the longitudinal axis located adjacent a juncture between the outer wall and the afterburner wall, and spaced inwardly from the afterburner wall.

9. The afterburner of claim 1 wherein the outer wall defines a plurality of apertures communicating between the main air bypass passageway and the afterburner chamber.

10. An afterburner for a turbofan engine having a generally annular external casing extending about a longitudinal axis, an outer wall spaced inwardly from the external casing so as to define a main air bypass passageway therebetween, an inner wall spaced inwardly from the outer wall so as to define an exhaust gas casing and a generally annular afterburner wall spaced inwardly from the external casing and defining an outer boundary of an afterburner chamber, comprising at least one connecting arm connecting the inner wall to the outer wall, each connecting arm defining: an air chamber; at least one inlet opening defined by the connecting arm communicating between the air chamber and the main air bypass passageway to allow a portion of the bypass air to pass into the air chamber; at least one outlet opening defined by the connecting arm and communicating between the air chamber and the afterburner chamber to allow air in the air chamber to pass into the afterburner chamber so as to form a first bypass air passageway; and a downstream edge facing the afterburner chamber spaced from an upstream end of the afterburner wall to define a second bypass air passageway between the downstream edge of the connecting arm and the afterburner wall, wherein each connecting arm has opposite sides, each opposite side defining a channel extending radially with respect to the longitudinal axis and further comprising at least one fuel conduit disposed in each channel.

11. The afterburner of claim 10 wherein the opposite sides of the connector arm converge into an edge facing the afterburner chamber, the opposite sides defining the at least one outlet opening.

12. The afterburner of claim 10 wherein each fuel conduit defines fuel outlet orifices oriented substantially perpendicularly to the longitudinal axis.

13. The afterburner of claim 10 further comprising a plurality of cooling holes defined by the afterburner wall communicating with the main air bypass passageway.

14. The afterburner of claim 10 further comprising at least one flameholder extending inwardly from the outer wall, each flameholder defining: a second air chamber; a second inlet communicating with the main air bypass passageway and the second air chamber; and a plurality of second outlets communicating between the second air chamber and the afterburner chamber.

15. The afterburner of claim 14 wherein the each flameholder has a substantially "V"-shaped cross-section and further comprising an air conduit located between the legs of the substantially "V"-shape, the air conduit defining the second air chamber, the second inlet and the plurality of second outlets.

16. The afterburner of claim 15 wherein the apex of the substantially "V"-shaped flameholder faces away from the afterburner chamber.

17. The afterburner of claim 15 wherein the substantially "V"-shaped flameholder defines a plurality of holes adjacent the apex of the "V" located so as to communicate between the exhaust gas passageway and a space between the legs of the "V" shape.

18. The afterburner of claim 19 further comprising a generally annular burner ring extending about the longitudinal axis located adjacent a juncture between the outer wall and the afterburner wall, and spaced inwardly from the afterburner wall.

19. The afterburner of claim 14 wherein the outer wall defines a plurality of apertures communicating between the main air bypass passageway and the afterburner chamber.

20. An afterburner for a turbofan engine having a generally annular external casing extending about a longitudinal axis, an outer wall spaced inwardly from the external casing so as to define a main air bypass passageway therebetween, an inner wall spaced inwardly from the outer wall so as to define an exhaust gas casing and a generally annular afterburner wall spaced inwardly from the external casing and defining an outer boundary of an afterburner chamber, comprising: (a) at least one connecting arm connecting the inner wall to the outer wall, each connecting arm defining: an air chamber; at least one inlet opening defined by the connecting arm communicating between the air chamber and the main air bypass passageway to allow a portion of the bypass air to pass into the air chamber; and at least one outlet opening defined by the connecting arm and communicating between the air chamber and the afterburner chamber to allow air in the air chamber to pass into the afterburner chamber so as to form a first bypass air passageway; and (b) at least one flameholder extending inwardly from the outer wall, each flameholder defining: a second air chamber; a second inlet communicating with the main air bypass passageway and the second air chamber; and a plurality of second outlets communicating between the second air chamber and the afterburner chamber.

21. The afterburner of claim 20 wherein each connecting arm comprises opposite sides converging into an edge facing the afterburner chamber, the opposite sides defining the at least one outlet opening.

22. The afterburner of claim 20 wherein each connecting arm has opposite sides, each opposite side defining a channel extending radially with respect to the longitudinal axis and further comprising at least one fuel conduit disposed in each channel.

23. The afterburner of claim 22 wherein each fuel conduit defines fuel outlet orifices oriented substantially perpendicularly to the longitudinal axis.

24. The afterburner of claim 20 wherein each connecting arm has a downstream edge facing the afterburner chamber spaced from an upstream end of the afterburner wall to define a second bypass air passageway between the downstream edge of the connecting arm and the afterburner wall.

25. The afterburner of claim 20 further comprising a plurality of cooling holes defined by the afterburner wall communicating with the main air bypass passageway.

26. The afterburner of claim 20 wherein the each flameholder has a substantially "V"-shaped cross-section and further comprising an air conduit located between the legs of the substantially "V"-shape, the air conduit defining the second air chamber, the second inlet and the plurality of second outlets.

27. The afterburner of claim 26 wherein the apex of the substantially "V"-shaped flameholder faces away from the afterburner chamber.

28. The afterburner of claim 26 wherein the substantially "V"-shaped flameholder defines a plurality of holes adjacent the apex of the "V" located so as to communicate between the exhaust gas passageway and a space between the legs of the "V" shape.

29. The afterburner of claim 20 further comprising a generally annular burner ring extending about the longitudinal axis located adjacent a juncture between the outer wall and the afterburner wall, and spaced inwardly from the afterburner wall.

30. The afterburner of claim 20 wherein the outer wall defines a plurality of apertures communicating between the main air bypass passageway and the afterburner chamber.

31. An afterburner for a turbofan engine having a generally annular external casing extending about a longitudinal axis, an outer wall spaced inwardly from the external casing so as to define a main air bypass passageway therebetween, an inner wall spaced inwardly from the outer wall so as to define an exhaust gas casing and a generally annular afterburner wall spaced inwardly from the external casing and defining an outer boundary of an afterburner chamber, comprising at least one connecting arm connecting the inner wall to the outer wall, each connecting arm defining: an air chamber; at least one inlet opening defined by the connecting arm communicating between the air chamber and the main air bypass passageway to allow a portion of the bypass air to pass into the air chamber; at least one outlet opening defined by the connecting arm and communicating between the air chamber and the afterburner chamber to allow air in the air chamber to pass into the afterburner chamber so as to form a first bypass air passageway; a downstream end wall oriented in a plane extending substantially perpendicular to the longitudinal axis, the end wall defining the at least one outlet opening; at least one flameholder extending inwardly from the outer wall, each flameholder defining: a second air chamber; a second inlet communicating with the main air bypass passageway and the second air chamber; and a plurality of second outlets communicating between the second air chamber and the afterburner chamber.

32. The afterburner of claim 31 further comprising a plurality of cooling holes defined by the afterburner wall communicating with the main air bypass passageway.

33. The afterburner of claim 31 wherein the each flameholder has a substantially "V"-shaped cross-section and further comprising an air conduit located between the legs of the substantially "V"-shape the air conduit defining the second air chamber, the second inlet and the plurality of second outlets.

34. The afterburner of claim 33 wherein the apex of the substantially "V"-shaped flameholder faces away from the afterburner chamber.

35. The afterburner of claim 33 wherein the substantially "V"-shaped flameholder defines a plurality of holes adjacent the apex of the "V" located so as to communicate between the exhaust gas passageway and a space between the legs of the "V" shape.

36. The afterburner of claim 31 further comprising a generally annular burner ring extending about the longitudinal axis located adjacent a juncture between the outer wall and the afterburner wall, and spaced inwardly from the afterburner wall.

37. An afterburner for a turbofan engine having a generally annular external casing extending about a longitudinal axis, an outer wall spaced inwardly from the external casing so as to define a main bypass passageway therebetween, an inner wall spaced inwardly from the outer wall so as to define an exhaust gas casing and a generally annular afterburner wall spaced inwardly from the external casing and defining an outer boundary of an afterburner chamber, comprising at least one connecting arm connecting the inner wall to the outer wall, each connecting arm defining: an air chamber; at least one inlet opening defined by the connecting arm communicating between the air chamber and the main air bypass passageway to allow a portion of the bypass air to pass into the air chamber; at least one outlet opening defined by the connecting arm and communicating between the air chamber and the afterburner chamber to allow air in the air chamber to pass into the afterburner chamber so as to form a first bypass air passageway; a downstream edge facing the afterburner chamber spaced from an upstream end of the afterburner wall to define a second bypass air passageway between the downstream edge of the connecting arm and the afterburner wall; at least one flameholder extending inwardly from the outer wall, each flameholder defining: a second air chamber; a second inlet communicating with the main air bypass passageway and the second air chamber; and a plurality of second outlets communicating between the second air chamber and the afterburner chamber.

38. The afterburner of claim 37 wherein each connecting arm comprises opposite sides converging into an edge facing the afterburner chamber, the opposite sides defining the at least one outlet opening.

39. The afterburner of claim 37 further comprising a plurality of cooling holes defined by the afterburner wall communicating with the main air bypass passageway.

40. The afterburner of claim 37 wherein the each flameholder has a substantially "V"-shaped cross-section and further comprising an air conduit located between the legs of the substantially "V" shape, the air conduit defining the second air chamber, the second inlet and the plurality of second outlets.

41. The afterburner of claim 40 wherein the apex of the substantially "V"-shaped flameholder faces away from the afterburner chamber.

42. The afterburner of claim 40 wherein the substantially "V"-shaped flameholder defines a plurality of holes adjacent the apex of the "V" located so as to communicate between the exhaust gas passageway and a space between the legs of the "V" shape.

43. The afterburner of claim 36 further comprising a generally annular burner ring extending about the longitudinal axis located adjacent a juncture between the outer wall and the afterburner wall, and spaced inwardly from the afterburner wall.

44. The afterburner of claim 36 wherein the outer wall defines a plurality of apertures communicating between the main air bypass passageway and the afterburner chamber.

* * * * *